US006862857B2

(12) United States Patent
Tychsen

(10) Patent No.: US 6,862,857 B2
(45) Date of Patent: Mar. 8, 2005

(54) STRUCTURAL PANELS AND METHOD OF CONNECTING SAME

(75) Inventor: Detlef Tychsen, Löhnc (DE)

(73) Assignee: Kronotec AG, Luzern (CH)

( * ) Notice: Subject to any disclaimer, the term of this patent is extended or adjusted under 35 U.S.C. 154(b) by 164 days.

(21) Appl. No.: 10/259,486

(22) Filed: Sep. 30, 2002

(65) Prior Publication Data

US 2003/0101681 A1 Jun. 5, 2003

(30) Foreign Application Priority Data

Dec. 4, 2001 (DE) ..... 101 59 284

(51) Int. Cl.[7] ..... E04B 2/00
(52) U.S. Cl. ..... 52/582.1; 52/591.1; 52/592.1
(58) Field of Search ..... 52/591.1, 592.1, 52/591.3, 589.1, 578

(56) References Cited

U.S. PATENT DOCUMENTS 757,812 A * 4/1904 Keyes ..... 403/364
6,006,486 A * 12/1999 Moriau et al. ..... 52/589.1
6,101,778 A * 8/2000 M.ang.rtensson ..... 52/582.1
6,505,452 B1 * 1/2003 Hannig et al. ..... 52/582.1
6,588,167 B2 * 7/2003 Chang ..... 52/590.1
6,601,359 B2 * 8/2003 Olofsson ..... 52/588.1

* cited by examiner

*Primary Examiner*—Peter M. Cuomo
*Assistant Examiner*—Stephen Vu
(74) *Attorney, Agent, or Firm*—McGuireWoods LLP

(57) ABSTRACT

A device for connecting and locking structural panels, particularly floor panels, having a groove forming an upper lip and a lower lip over the entire length of at least one lateral border and with a tongue formed on the opposite lateral border corresponding to the groove. To lock panels that have been connected, the tongue is provided with at least one projection and the groove exhibits at least one indentation on the lip that faces the projection, which device is characterized by the indentation being longer than the projection, and on its lateral border ($I_3$, $I_4$) the lip provided with at least one indentation exhibits at least one recess reaching back to the indentation. The length of the recess is at least as great as the length of the projection, and seen in the longitudinal direction, the recess and the projection occupy positions that are staggered, one relative to the other.

25 Claims, 4 Drawing Sheets

15
1
6
4
3
$Q_{10}$
$Q_L$
7
10
10
5
$I_3$
Q
L 15
2
9
8
11
8
11
$L_8$
II 1
8
2

L
Q
1
2
3
4
7
8
10
12
13
14
20
26
β

STRUCTURAL PANELS AND METHOD OF CONNECTING SAME

BACKGROUND OF THE INVENTION

1. Field of the Invention

The present invention relates to an apparatus for connecting and locking structural panels, and more particularly to a locking structure of floor panels and a method of locking floor panels using the locking structure.

2. Background Description

Locking mechanism for floor panels are known, for example, DE 100 08 108. In such floor panels, a groove forms an upper lip and a lower lip over the entire length of at least one lateral border, and a tongue is formed on the opposite lateral border which corresponds to the groove. To lock panels that have been connected, the tongue is provided with at least one projection and the groove exhibits at least one indentation on the lip that faces the projection. The locking mechanism created by the corresponding profiling of the tongue and the groove forms a so-called "click profile". Two panels are connected by inserting the tongue of one panel into the groove of the other panel, until the projection on the lower side of the tongue clicks into the recess formed in the lower lip of the groove.

In addition, panels are known from U.S. Pat. No. 4,426,820 or CH 562 377 A5 which are connected in the laying process by inserting the tongue of a new panel in an angular fashion into the groove of an already laid panel, and then lowering the panel to the floor. The tongue and groove of the two panels engage with each other so that panels are locked both in the transverse direction and perpendicular to the upper panel surface. These types of floor panels, as well as others, can be manufactured from diverse materials such as, for example, from a wood material, particularly MDF or HDF. The upper side is formed with a decorative layer applied to the core.

Panels that are combined to form a floor cover must be tight at the area of connection in the top surface to prevent moisture from penetrating the connection and to prevent the core material of the panels from swelling. For this reason the "clicking" mechanisms are designed in such a way that two panels inserted into each other are in a state of tension and the connected points are solidly pressed together at the surface. However, the core material of known panels is relatively sensitive, which is often not realized, particularly by those engaged in home repair. If care is not taken when laying the panels and if strong forces are exerted when a new panel is inserted or swung downwards there is the danger that the lower lip of the groove will buckle. This results in the required stress not being able to be applied to the floor panels during installation since the position of the interlocking mechanism has changed. Accordingly, it will become impossible to firmly join the panels. Also, if the lower lip buckles too much it is possible that the groove will be broken, a circumstance that cannot be identified from the outside.

It is further noted that the production of the click profiles is rather involved, since maintaining the given tolerances requires careful milling of the core material and demands continuous quality control. If, for example, tool wear results in the projection on the tongue being insufficiently high, the two panels will not lock together in solid fashion, and the danger will arise of the panels separating or of surface gaps forming at the connecting points. If the projection is too high it will not fit the lower lip of the panel provided with the groove. The danger may also arise of the lower lip buckling and being broken or the projection being damaged (ground down), making a solid connection of the panels impossible.

SUMMARY OF THE INVENTION

Proceeding from this complex set of problems, the goal of the present invention is to improve the apparatus described above for connecting and interlocking structural panels, namely in such a way that a secure connection between two panels is assured and the connection cannot be unintentionally broken.

In one aspect of the present invention, the indentation is longer than the projection. On the lateral border the lip provided with at least one indentation exhibits at least one recess extending back to the indentation, while the recess is at least as long as the projection. And, the recess and the projection are offset, one relative to the other, in the longitudinal direction of the lateral border. With this design it is possible to adjust the recess, the projection, and the indentation such that in connecting two panels the projection can be introduced into the recess until it engages with the indentation and the structural panels can be moved relative to each other in the longitudinal direction of the lateral border for the purpose of interlocking. This results in a bayonet-like locking of the two panels, both in the longitudinal direction of the lateral border and in its transverse direction and perpendicular thereto. Separating the two panels is then possible when the two panels are moved in opposite directions. Panels that have once been connected can no longer be separated without deliberate mechanical action.

The tongue may be provided with a plurality of spaced projections, and the lip may be provided with at least one indentation which exhibits a number of recesses corresponding to the projections. This design makes it possible to lock together parts that are wide relative to the longitudinal direction of the lateral border, thereby increasing the strength of the connection. It is advantageous if the projections are positioned at regular intervals in order to facilitate the connection of panels, e.g., when laying a floor board. If the installation is intended for floor panels, it is further advantageous if at least one indentation is provided in the lower lip of the groove, since the person laying the panels can then see the panel profile. With respect to the lip exhibiting the indentation, a successful degree of tension can be established at the connecting point of two panels if the side of l the ip facing the groove runs at angle toward the surface of the panel. The indentation can be produced simply if it extends over the full length of the lip, since then it can be milled in a single run.

If the lateral borders of the projection are beveled relative to the longitudinal direction of the lateral border, there will be a self-centering process among the panels when they are connected. Ideally, the lateral borders of the recesses will be beveled accordingly. The angle of the bevel lies in the range from 0 to 90° and will ideally range from 25 to 60°, particularly 45°. The connection will exhibit balanced properties when the tongue is provided with three projections.

In embodiments, the tongue and groove design described above will be provided on the transverse side of the panel. The bayonet-like connection provides a locking arrangement without the exertion of force, thereby preventing the groove from breaking. With the selection of the projection height a very secure lock can be achieved, one which is resistant to high shearing forces.

If the contouring described above is provided on the transverse side of the panel, it may be advantageous if a tongue is also provided on one of the longitudinal sides and if a groove corresponding to the tongue is provided on the opposite longitudinal side, such that said groove exhibits an upper lip and a lower lip, while the tongue is designed so that it can engage with the groove in the longitudinal direction, against the lower lip. With this kind of design a fixed connection of the panels is assured in the longitudinal and transverse directions.

In embodiments, the lower side of the tongue and the upper side of the lower lip will run in an arch, which allows a large contact surface between the locking means. It is advantageous if a second groove is provided between the lower side and the tongue, i.e., a groove that runs over the length of the longitudinal border and that forms a lower lip, and if the lower lip of the second groove at least partially locks with the lower lip of the first groove when the panels are joined. With this kind of design, and for floor panels particularly, the lower lip in danger of buckling is supported from below by the freshly inserted panel so that the two connected panels reciprocally support each other in the vertical direction. If the lower lip buckles when a new panel is inserted, it is pressed back into normal position when the new panel is lowered to the floor. Further buckling can thus no longer occur. The bracing force that is established by the other structural conditions is therefore securely maintained.

In further aspects of the present invention, the other groove opposite the lower side of the panel will run at an inclined angle. The angle lies between 30° and 60° and will ideally equal 45°. With this design, a good distribution of force at the point of connection is made possible. If the lower lip of the first groove is designed so as to taper toward the underside, the interlocking process with the other lower lip is facilitated when the newly inserted panel is swung down. The bracing force at the point of connection on the surface can be increased if both the tongue and the groove close to the upper surface are provided with a catch. By selecting the size of the catch it is possible to adjust the size of the contact surface at the connection point, as well as the degree of pressure.

At the transverse side the floor panels are joined together and locked according to the following steps:

(a) the tongue side of the first panel and the groove side of a second panel are positioned in such a way that the projection, of which there is at least one, lies opposite the recess, of which there is also at least one;

(b) the panels are moved relative to each other in the longitudinal direction, in the process of which the tongue enters the groove until the projection is covered by the indentation in the lip; and (c) the panels are moved relative to each other in the direction of the connecting edges (transverse direction) while the projection leaves the area of the recess, thus producing a bayonet-like lock.

Floor panels whose lateral border is contoured on the transverse side and whose lateral border is contoured differently on the longitudinal side are laid down and connected according to the following steps:

(a) connecting and interlocking a plurality of panels on their transverse sides in laying down an initial row on the floor of a room;

(b) connecting and interlocking another panel on its longitudinal side with at least one of the panels laid down in the first row to start a second row;

(c) positioning a new panel with its transverse side facing the transverse side of the previously laid other panel in the second row, where the projection(s) of the tongue face the recess(es) of the lip;

(d) sliding the new panel horizontally in the longitudinal direction until the tongue enters the groove and the projection overlaps with the indentation in the lip;

(e) sliding the new panel in the transverse direction while the projection leaves the area of the recess and the bayonet-like interlocking process begins;

(f) angular lifting of the two panels that already partially interlock on the transverse sides;

(g) sliding the new panel in the transverse direction until the interlocking process is completed when the groove and tongue of the new panel are connected with the longitudinal side of at least one panel in the first row; and (h) angling the two panels in the second row onto the floor, with interlocking on the longitudinal side.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
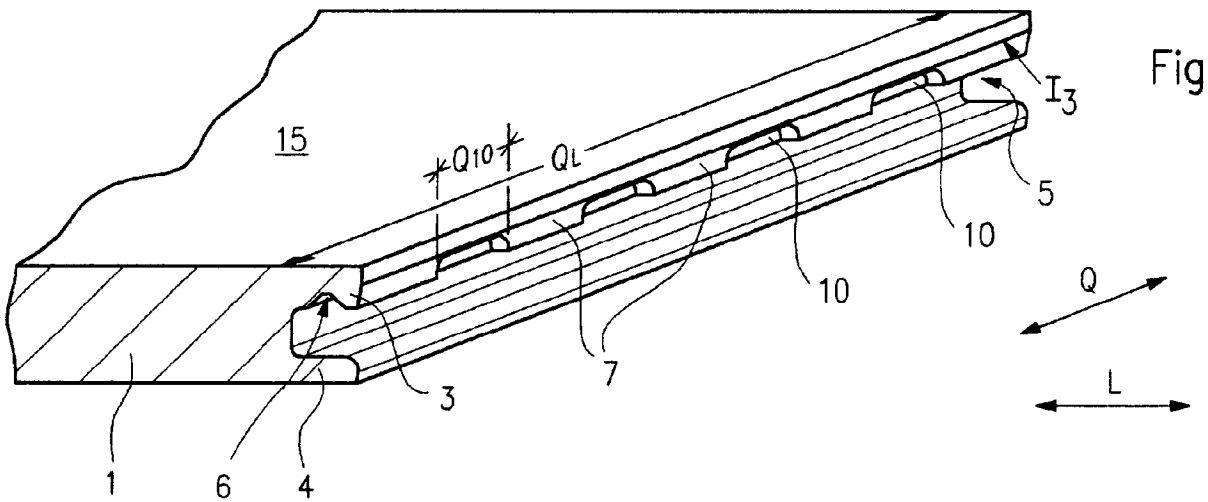
FIG. 1 shows an initial floor panel in a partial perspective view.

For purposes of clarity, in the embodiments described below the same components or profiles are designated with the same reference numerals and the like.

Figure 2:
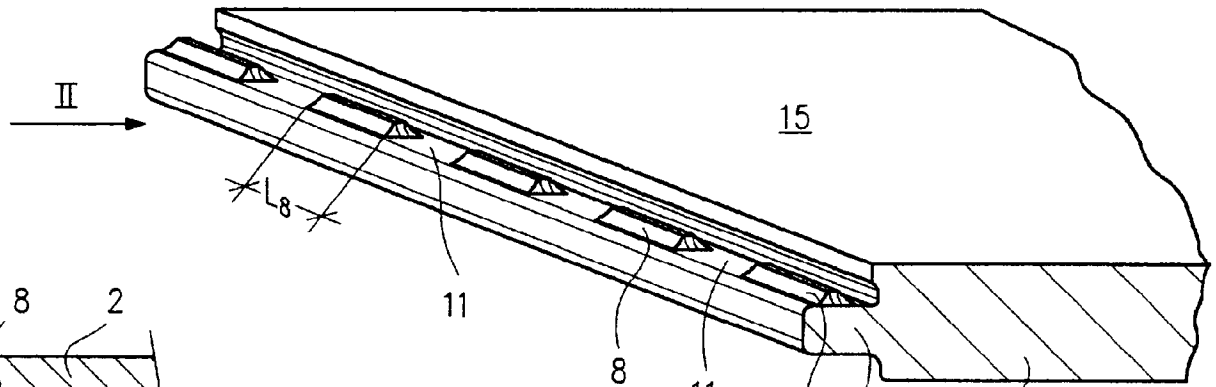
FIG. 2 shows a second floor panel in a partial perspective view.
Figure 3:
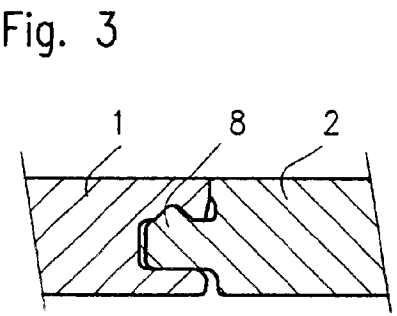
FIG. 3 shows two connected panels of FIGS. 1 and 2 at a point of connection, in cross-section.
Figure 4:
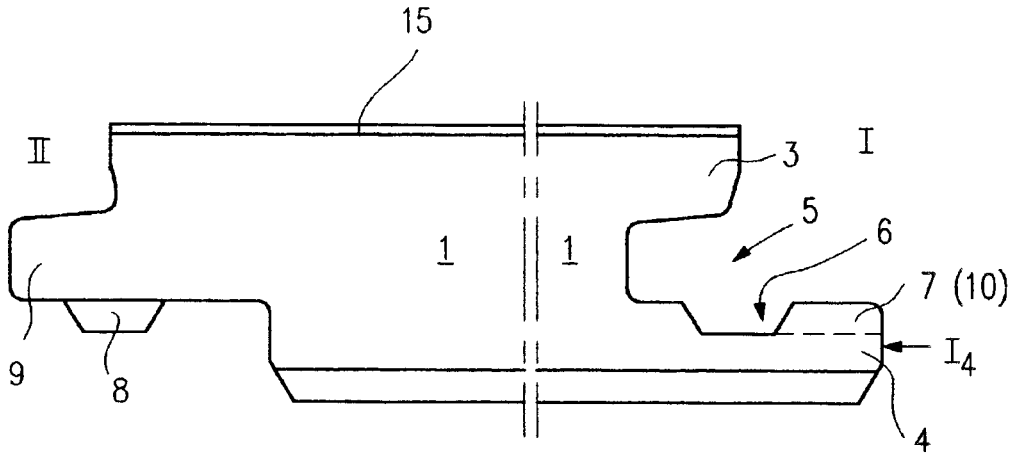
FIG. 4 shows another floor panel according to the present invention.
Figures 6, 7, 8, 9:
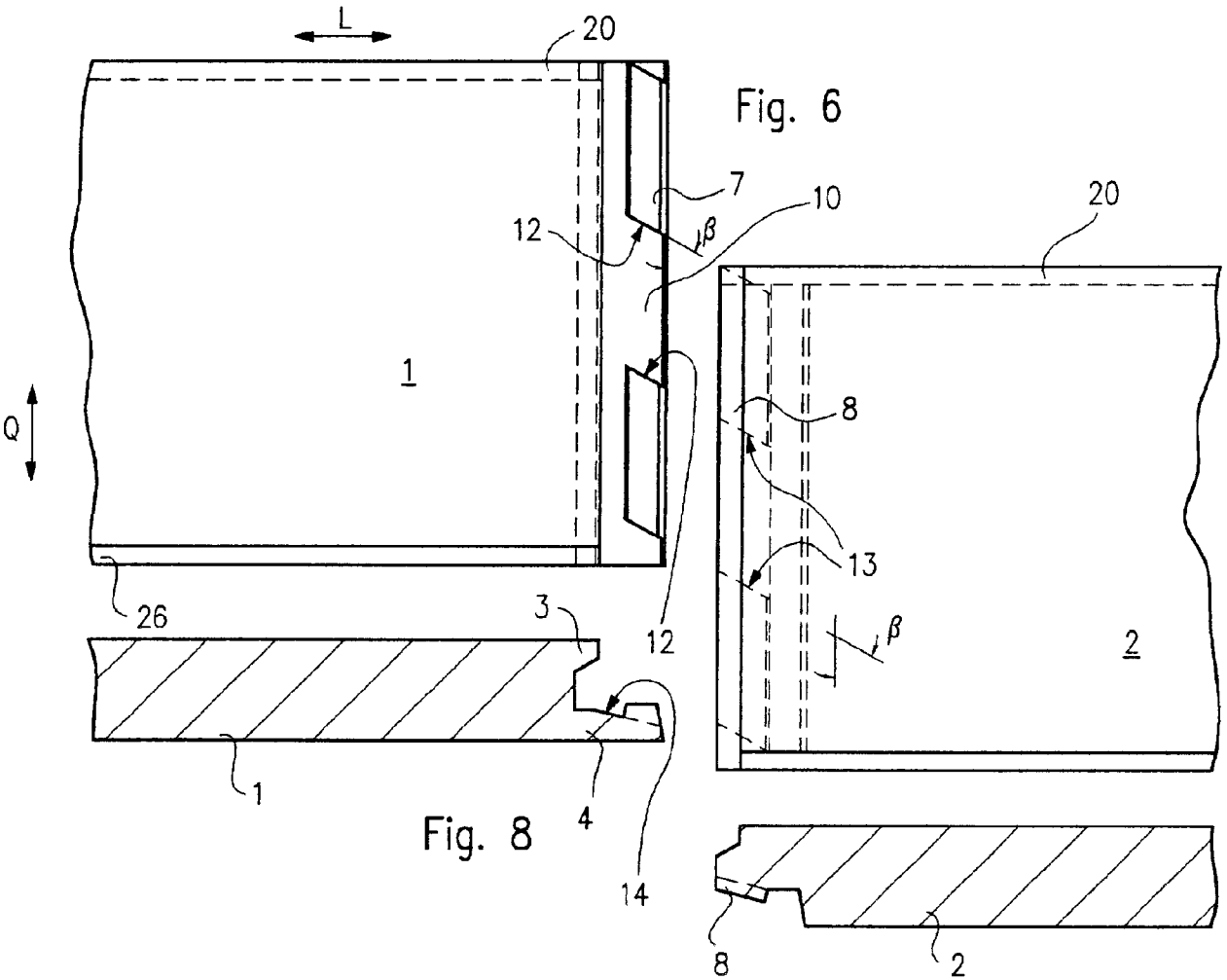
FIG. 6 shows a top view of a floor panel shown in FIG. 4 showing a lateral border that is provided with the groove.
FIG. 7 shows a top view of the floor panel shown in FIG. 4 showing the lateral border that is provided with the tongue.
FIG. 8 shows a partial section through the panel shown in FIG. 6.
FIG. 9 shows a partial section through the panel shown in FIG. 7.
Figure 10:
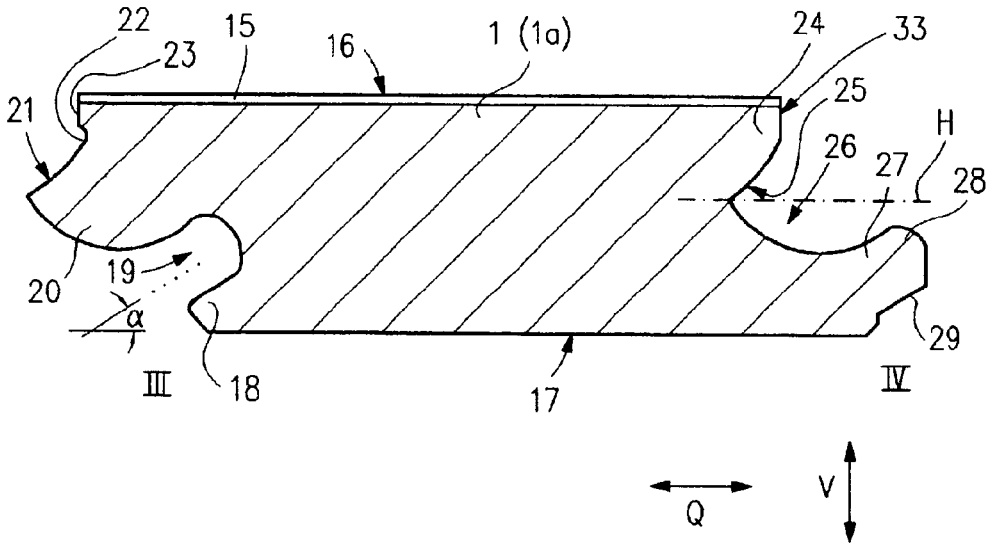
FIG. 10 shows a contouring of the panel on its longitudinal side.

Referring now to FIGS. 1–3, panels 1, 2 are provided on a traverse side I with a contour in accordance with FIG. 1, 2 or 4 or, alternatively, FIGS. 8 and 9. A contour in accordance with FIG. 10 is, in embodiments, provided on the longitudinal side. In embodiments, the panels 1, 2 consist of a moderately dense or highly compressed fiberboard (MDF or HDF). The structural panels may also consist of a material such as wood, plaster or plastic. The upper surface 16 of the panels 1, 2 are provided with a decorative upper layer 15 which may be formed, e.g., by a paper layer exhibiting a wood grain and coated with a layer of synthetic resin for protection against wear. A sound-proofing layer may additionally be glued to the underside 17 in order to improve the acoustic properties of the floor with respect to walking noise. A laminate of this kind has long been known.

The panel 1, 2 is provided on the traverse side with a groove 5 that forms an upper lip 3 and a lower lip 4. The groove 5 extends over the entire length $Q_L$ of the lateral border, generally depicted as reference I. As seen, for example, in FIG. 2, a tongue 9 is formed on the opposite lateral border II, which also runs the entire length $Q_L$ of the lateral border. Referring back to FIG. 1, the upper lip 3 is provided over its entire length $Q_L$ with an indentation 6 formed out of the core material. On the lateral border 13, the upper lip 3 is provided with a number of recesses 10 spaced in parallel fashion and extending in the longitudinal direction L of the panel 1, 2 back to the indentation 6. The recesses 10 are preferably positioned at regular intervals and form stops 7 therebetween. On its upper surface of the tongue 9, a number of projections 8 are provided. The projections 8 are spaced at intervals and form intermediate spaces 11. The length $L_8$ of the projections 8 is less than the length $L_{10}$ of the intermediate spaces 10. As can be seen by comparing FIGS. 1 and 2, the projections 8 and the recesses 10 are positioned over the transverse direction Q in staggered fashion one relative to the other and are preferably identical in number.

To connect the panels 1, 2 on their transverse sides, the panels are positioned in facing fashion such that the projections 8 are aligned with the recesses 6 and the spaces 1 are aligned with the stops 7. The panel 2 is then moved in the longitudinal direction L toward the panel 1, causing the tongue 9 to enter the groove 5, inasmuch as the projections 8 match the recesses 10. When the projections 8, having a cross-section corresponding to that of the indentation 6, are positioned within the indentation 6, the panel 2 is shifted in the transverse direction Q, so that the projections 8 are moved from the area of the recesses 10 and engage behind the stops 7 formed between the recesses 10 and by the indentation 6, with the result that there is a bayonet-like locking of the panels 1, 2 that prevents movement in the longitudinal direction L. FIG. 3 shows the panels of FIGS. 1 and 2 in the locked position, where the projections 8 are located relative to the stops 7.

Figure 5:
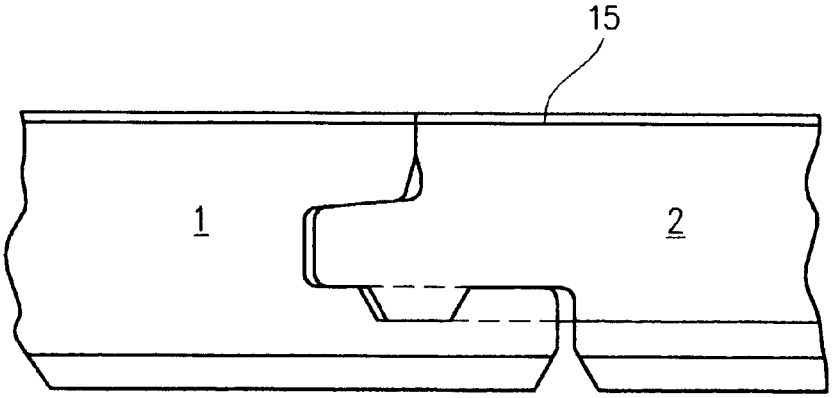
FIG. 5 shows two connected floor panels shown in FIG. 4 in the area of the connection.

In the panel shown in FIG. 4, the lower lip 4 protrudes laterally beyond the upper lip 3. The indentation 6 in the lower lip 4 is milled over the entire length $Q_L$ of the lateral border 1. As in the depiction given in FIG. 2, a plurality of projections 8 are spaced over the underside of the tongue 9. The cross-section of these projections 8 corresponds to that of the indentation 6. Analogous to the depiction in FIG. 1, a matching number of regularly spaced recesses 10 are provided on the lateral border 14 of the lower lip 4. These recesses 10 are, in embodiments, greater in length than the projections 8. The locking mechanism operates in the same manner as described above. FIG. 5 shows the locking of the panels 1, 2 depicted in FIG. 4.

As can be seen from the schematic depiction in FIGS. 6 and 7, the facing sides 1, 2, 13 of the projections 8 or the stops 7 created by the recesses 10 may run diagonally at an angle β. The angle β can range from almost 0° to 90°. Ideally, however, this angle will be 25°, 45°, or 60°. Given this diagonal contour, the panel 2 can be introduced into panel 1 at an angle, which makes possible a self-centering of the two panels 1, 2, which facilitates the connecting process. To produce a bracing force on the surface of the connection, an upper surface 14 of the lower lip 4 and the lower side of the projections 8 can run at an angle (compare, FIGS. 8, 9).

Figure 11:
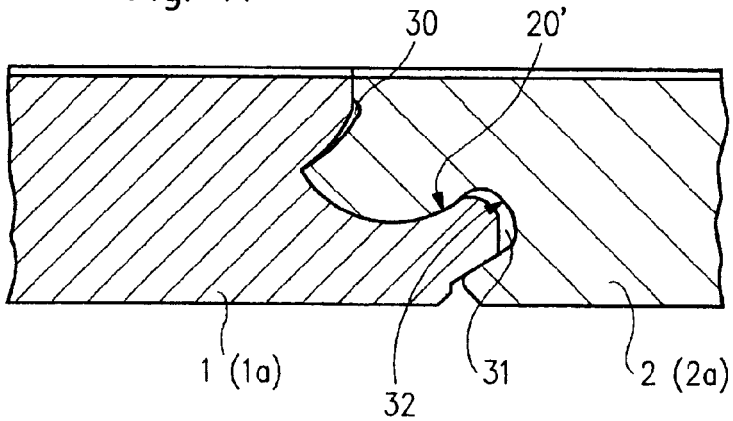
FIG. 11 shows two connected panels according to FIG. 10 in the area of the connecting point, in cross section.

On the longitudinal sides, the panels 1, 2 are provided with the profile visible in FIG. 10. On one lateral border III, the panel 1, 2 is provided with a tongue 20 and on the opposite lateral border IV with a groove 26. The groove 26 and tongue 20 run over the full length of the lateral borders III, IV. As FIG. 10 shows, the tongue 20 and groove 26 are provided with curved walls. Their primary axis H runs in the transverse direction Q. Provided on the tongue 20 is an outwardly projecting nose 21 that locks with a catch 22 in the groove 26. Between the tongue 20 and the underside 17 there is another groove 19, which runs at an angle α of approximately 30° relative to the underside 17 and which has a rounded base. This groove 19 forms a lower lip 18 on the underside 17, and further includes a groove base 32 at a closed end thereof. The lower lip 27 of the first groove 26 formed on the opposite lateral border IV runs outward at an upward angle α and terminates with a projection 28. Toward the underside 17, the outer portion of the lower lip 27 is tapered and provided with a diagonal edge 29. In this configuration, there is an open space between the underside 17 and the lower lip 27. The edge 29 also runs at an angle α to the underside 17. As FIG. 11 shows, when the panels 1, 2 are connected the lower lip 18 supports the lower lip 27 by engaging with the open space 30 formed by the slope or diagonal edge 29. Because both the edge 29 and the groove 19 run at an angle α of approximately 30° the two panels 1, 2 support each other. The projection 28 catches behind the belly of the tongue 20 and provides a lock in the transverse direction Q. When the catch or nose 21 of the tongue 20 engages with the catch 25 there is a lock in the vertical direction V.

The contact surface 23 left by the nose 21 is smaller than the vertically extending wall 33 of the groove 26. This configuration provides a squeezing at the surface of the connecting area. Buckling of the lower lip 27 is prevented by the support provided by the lower lip 18, and the structurally determined (i.e., by the dimensions of the tongue and groove) surface pressure at the connecting area is maintained. To facilitate the connection of two panels 1, 2, the depth of the groove 19 is greater than the outward projection of the lower lip 27 so that an open space 30 forms when the panels 1, 2 are connected. At the same time an open space 31 is formed by the catch 25. The open spaces 30, 31 serve as dust pockets into which any shavings that remain after the profile is milled can escape.

Before the connection of the panels 1, 2 is discussed it should be understood that two panels 1, 2 cannot be connected on their transverse and longitudinal sides simultaneously. Since only identically formed panels 1, 2 that correspond on their longitudinal sides and their transverse sides can be connected, the panel designation used above is retained; however, a further designation "a" is added to the connecting panels for purposes of clarity.

To lay a floor an initial row of panels 1, 2 are first connected on their transverse sides Q. To form a second row, a panel 1*a* is then inserted with its tongue 20 on the longitudinal side L into the groove 26 of at least one of the panels 1, 2 laid in the first row and is lowered to the floor; this results in the panels locking in the transverse direction Q and the vertical direction V. Another panel 2*a* is then laid with its transverse side against the transverse side of the first panel 1*a* laid in the second row, in the process of which the projections 8 are positioned opposite the recesses 10, and the panel 2*a* currently being laid is inserted in the longitudinal direction L into the first panel 1*a* already lying in the second row. When the tongue 9 has completely entered the groove 5 and the projections 8 coincide with the indentation 6, the panel 2*a* is pushed in the transverse direction Q so that the projections 8 arc partially locked by the stops 7. Both panels 1*a*, 2*a* are lifted and are completely locked together. On its longitudinal side, the new panel 2*a* is then inserted with its tongue 20 into the groove 26 of the panel 1, 2 laid in the first row, and both panels 1*a*, 2*a* are lowered to the floor, resulting in the lock described above.

It will be apparent to those skilled in the art that various modifications and variations can be made in the apparatus and methods described herein. Thus, while the invention has been described in terms of preferred embodiments, those skilled in the art will recognize that the invention can be practiced with modification within the spirit and scope of the appended claims.

What is claimed is:

1. An apparatus for connecting and locking structural panels, wherein the apparatus comprising:

a groove forming an upper lip and a lower lip over an entire length of at least one lateral border, the groove being provided with an indentation on one of the upper lip and the lower lip; and a tongue formed on an opposite lateral border and which corresponds to the groove, the tongue being provided with at least one projection and the groove faces the at least one projection, wherein the indentation is longer than the at least one projection, the one of the upper lip and the lower lip provided with the at least one indentation further includes at least one recess reaching back to the indentation, a length of the at least one recess is at least as great as a length of the at least one projection, and the at least one recess and the at least one projection occupy positions that are staggered, one relative to the other.

2. The apparatus according to claim 1, wherein the tongue is provided with a plurality of spaced projections and the plurality of recesses correspond to that of the plurality of spaced projections.

3. The apparatus according to claim 2, wherein the tongue is provided with three projections.

4. The apparatus according to claim 2, wherein the plurality of spaced projections are positioned at regular integrals, one relative to another.

5. The apparatus according to claim 1, wherein the indentation is provided in the lower lip.

6. The apparatus according to claim 1, wherein the indentation extends over the entire length of the one of the upper lip and the lower lip.

7. The apparatus according to claim 1, wherein the lower lip is provided with the indentation such that a surface of the lower lip that faces the groove runs at an angle inclined toward the surface of the panel.

8. The apparatus according to claim 1, wherein a front edge of the projection is beveled at an angle (β) relative to the transverse direction.

9. The apparatus according to claim 8, wherein the angle (β) is in the range from 0° to 90°.

10. The apparatus according to claim 8, wherein the angle (β) is in the range from 25° to 60°.

11. The apparatus according to claim 1, wherein the tongue and groove is provided on a transverse side of the panel.

12. The apparatus according to claim 11, wherein:

a second tongue is provided on one longitudinal side and a second groove corresponding to the second tongue is provided on an opposite longitudinal side, and the second groove forms an upper lip and a lower lip and the second tongue clicks into the second groove in a transverse direction and rests against the lower lip of the second groove.

13. The apparatus according to claim 12, wherein the lower side of the second tongue and the upper side of the lower lip of the second groove are an arc-shaped.

14. The apparatus according to claim 13, wherein:

a third groove extends over a length of a longitudinal border is provided between an underside of the panel and the second tongue, the third groove forms a lower lip, and the lower lip of the third groove at least partially engages with the lower lip of the second groove when the panels are connected.

15. The apparatus according to claim 14, wherein the third groove runs at an inclined angle (α).

16. The apparatus according to claim 15, wherein the angle (α) is between 30° and 60°.

17. The apparatus according to claim 16, wherein the angle (α) is 45°.

18. The apparatus according to claim 12, wherein the lower lip of the second groove tapers at an angle toward the underside.

19. The apparatus according to claim 12, wherein both the second groove and the second tongue close to the upper surface are provided with a catch.

20. The apparatus of claim 1, wherein the at least one projection is a plurality of spaced apart projections and the at least one recess is a plurality of spaced apart recesses configured to be staggered.

21. A process for connecting and locking floor panels, the floor panels including a groove forming an upper lip and a lower lip over an entire length of at least one lateral border and a tongue formed on an opposite lateral border and which corresponds to the groove, the tongue being provided with at least one projection and the groove being provided with at least one recess, a stop and at least one indentation on one of the upper lip and the lower lip, the at least one indentation corresponds to the at least one projection, wherein the connecting steps comprise:

the tongue of a first panel and the groove of a second panel are positioned in such a way that the at least on projection lies opposite the at least one recess;

one of the first panel and the second panel are moved relative to each other in a longitudinal direction such that the tongue enters the groove until the at least one projection is covered by the indentation in one of the upper lip and the lower lip; and the one of the first panel and the second panel are moved relative to each other in a transverse direction such that the at least one projection leaves the area of the recess and is positioned behind the stop thus producing a lock.

22. A process for laying and mechanically connecting floor panels, wherein transverse sides of the floor panels have a lateral border including:

a groove forming an upper lip and a lower lip over an entire length of at least one lateral border, the one of the upper lip and the lower lip provided with at least one indentation, at least one recess and an adjacent stop, a length of the at least one recess is at least as great as a length of the at least one projection, and the at least one recess and the projection occupy positions that are staggered, one relative to the other, and a tongue formed on an opposite lateral border which corresponds to the groove, the tongue being provided with at least one projection that corresponds to the at least one projection, the indentation being longer than the projection and the at least one recess reaching back to the indentation, and wherein longitudinal sides of the floor panels have a lateral border including:

a second tongue provided on one longitudinal side and a second groove corresponding to the second tongue is provided on an opposite longitudinal side, wherein the second groove forms an upper lip and a lower lip and the second tongue clicks into the second groove in a transverse direction and rests against the lower lip of the second groove, wherein a lower side of the second tongue and an upper side of the lower lip of the second groove are arc-shaped, and a third groove extends over a length of the longitudinal side provided between an underside of the panel and the second tongue, the third groove forms a lower lip, the connecting steps including:

connecting and interlocking a plurality of panels on the transverse sides to lay an initial row on a floor;

connecting and interlocking another panel on its longitudinal side with at least one of the previously laid and interlocked panels laid down in the first row, as a beginning of a second row;

positioning a new panel with its transverse side facing the transverse side of the another panel in the second row, where the projection of the tongue faces the recess of the one of the upper lip and lower lip;

sliding the new panel horizontally in the longitudinal direction until the tongue enters the groove and the projection is covered by the indentation in the one of the upper lip and lower lip of the another panel;

sliding the new panel in the transverse direction while the projection leaves the area of the recess and the interlocking process begins;

angular lifting of the two partially interlocked another panel and new panel that are connected on their transverse sides;

sliding the new panel in the transverse direction until the interlocking process is completed on the transverse side and the second groove and second tongue of the new panel are connected with the longitudinal side of at least one panel in the first row; and angling the laid panel and the new panel in the second row onto the floor, with interlocking on the longitudinal side.

23. The process of claim 21, further comprising aligning the projection with the recess during or after the positioning step.

24. The process of claim 23, wherein when the one of the first panel and the second panel are moved relative to each other the projection enters the recess which backs to the indentation in order for the projection to lie within the indentation.

25. The process of claim 21, wherein when the one of the first panel and the second panel are moved relative to each other the projection enters the recess which backs to the indentation in order for the projection to lie within the indentation.

* * * * *

UNITED STATES PATENT AND TRADEMARK OFFICE

CERTIFICATE OF CORRECTION

PATENT NO. : 6,862,857 B2
DATED : March 8, 2005
INVENTOR(S) : D. Tychsen

It is certified that error appears in the above-identified patent and that said Letters Patent is hereby corrected as shown below:

Title page,
Item [30], Foreign Application Priority Data, "101 59 284" should be -- 101 59 284.1 --.

Column 7,
Lines 30-31, "the other" should be -- another --.
Line 40, "integrals" should be -- intervals --.
Line 60, "claim 11" should be -- claim 1 --.

Column 8,
Line 40, "on" should be -- one --.
Line 54, after "over" insert -- at least --.
Line 60, after "recess" delete "and the".

Column 9,
Line 7, after "in" delete "a".
Line 29, before "lower lip" insert -- the --.

Signed and Sealed this

Twenty-second Day of November, 2005

JON W. DUDAS
*Director of the United States Patent and Trademark Office*